US011162245B2

(12) United States Patent
Nakajima

(10) Patent No.: US 11,162,245 B2
(45) Date of Patent: Nov. 2, 2021

(54) STICK CONTROL SYSTEM IN CONSTRUCTION MACHINE

(71) Applicant: Caterpillar SARL, Geneva (CH)

(72) Inventor: Hideki Nakajima, Akashi (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 16/620,111

(22) PCT Filed: Jun. 19, 2018

(86) PCT No.: PCT/EP2018/066314
§ 371 (c)(1),
(2) Date: Dec. 6, 2019

(87) PCT Pub. No.: WO2018/234340
PCT Pub. Date: Dec. 27, 2018

(65) Prior Publication Data

US 2020/0190770 A1 Jun. 18, 2020

(30) Foreign Application Priority Data

Jun. 19, 2017 (JP) ..... JP2017-119562

(51) Int. Cl.
*E02F 9/22* (2006.01)
*F15B 11/024* (2006.01)
(Continued)

(52) U.S. Cl.
CPC ..... *E02F 9/2221* (2013.01); *E02F 3/435* (2013.01); *E02F 9/2217* (2013.01);
(Continued)

(58) Field of Classification Search
CPC ..... F15B 2211/3133; F15B 13/021; F15B 2211/31582; F15B 2211/30565;
(Continued)

(56) References Cited

U.S. PATENT DOCUMENTS 6,467,264 B1 * 10/2002 Stephenson ..... F15B 11/006 60/368
7,451,685 B2 * 11/2008 Tabor ..... F15B 11/006 91/361
(Continued)

FOREIGN PATENT DOCUMENTS

JP 02085503 3/1990
JP H10 311305 A 11/1998
(Continued)

OTHER PUBLICATIONS

International Search Report for related International Application No. PCT/EP2018/066314 report dated Oct. 4, 2018.

*Primary Examiner* — Dustin T Nguyen

(57) ABSTRACT

To achieve the improvement of recovery efficiency from a rod end oil chamber to a head end oil chamber during extending operation of a stick cylinder, and at the same time, to prevent an operation speed of the stick cylinder from being impaired when recovery is impossible, as well as to achieve the reduction of the number of parts, in a construction machine equipped with a stick. It is configured such that a first region Y1 at which a discharge valve passage 14*g* is opened while being throttled and a second region Y2 at which the discharge valve passage 14*g* is wider opened than at the first region Y1 are provided, in an operating position of a stick control valve 14 during extending operation of the stick cylinder, and if recovery from the rod end oil chamber 9*b* to the head end oil chamber 9*a* during extending operation of the stick cylinder 9 is possible, the stick control valve 14 is caused to be positioned at the first region Y1, and if the recovery is impossible, positioned at the region Y2.

4 Claims, 7 Drawing Sheets

(51) Int. Cl.

| | |
|---|---|
| ***E02F 3/43*** | (2006.01) |
| ***F15B 13/02*** | (2006.01) |
| ***F15B 13/04*** | (2006.01) |

(52) U.S. Cl.
CPC ..... *E02F 9/2282* (2013.01); *E02F 9/2292* (2013.01); *F15B 11/024* (2013.01); *F15B 13/021* (2013.01); *F15B 13/0401* (2013.01); *F15B 2013/0413* (2013.01); *F15B 2211/20576* (2013.01); *F15B 2211/30565* (2013.01); *F15B 2211/3116* (2013.01); *F15B 2211/3133* (2013.01); *F15B 2211/31582* (2013.01); *F15B 2211/45* (2013.01); *F15B 2211/6309* (2013.01); *F15B 2211/6313* (2013.01); *F15B 2211/6346* (2013.01)

(58) Field of Classification Search
CPC ..... F15B 2211/45; F15B 2211/20576; F15B 2211/6309; F15B 2211/6346; F15B 2211/3116; F15B 2211/6313; F15B 11/024; F15B 21/14; E02F 9/2217; E02F 9/2292; E02F 9/2221; E02F 9/2282
See application file for complete search history.

(56) References Cited

U.S. PATENT DOCUMENTS

| | | | | |
|---|---|---|---|---|
| 8,096,227 | B2 * | 1/2012 | Brickner | F15B 11/024 91/436 |
| 10,233,613 | B2 * | 3/2019 | Honda | E02F 9/128 |
| 2017/0016460 | A1 | 1/2017 | Jung | |

FOREIGN PATENT DOCUMENTS

| | | | |
|---|---|---|---|
| JP | 2010 230060 | A | 10/2010 |
| KR | 2001 0061822 | A | 7/2001 |
| WO | WO 2009/084853 | A2 | 7/2009 |

* cited by examiner

STICK CONTROL SYSTEM IN CONSTRUCTION MACHINE

TECHNICAL FIELD

The present invention relates to a technical field of a stick control system in a construction machine equipped with a stick that swings based on an extending and contracting operation of a stick cylinder.

BACKGROUND ART

Generally, among construction machines, there are some for example, like hydraulic shovels that are configured such that a front work implement mounted on a machine body is configured to use a boom with a base end portion being supported by the machine body in a vertically movable manner, a stick supported longitudinally swingably to a leading end portion of the boom, and a working attachment such as a bucket attached to the leading end of the stick, wherein the swing of the stick is performed based on an extending and contracting operation of a stick cylinder. In this construction machine, a swing of the stick to cause a leading end portion of the stick to move in a direction of approaching to the machine body by extending the stick cylinder is taken as stick-in, and a swing of the stick to cause the leading end portion of the stick to move in a direction parting away from the machine body by contracting the stick cylinder is taken as stick-out. When stick-in operation is performed, in a state where the front work implement is not touching down the ground and the leading end portion of the stick is positioned (extended) in front of the machine body beyond the vertical line passing a swinging fulcrum of the base end portion of the stick, a weight applied to the stick acts as a stick-in side, that is, a force to extend the stick cylinder, consequently oil discharged from a rod end oil chamber becomes high pressure, and on the other hand, pressurized oil to be supplied to a head end oil chamber may be low pressure oil. Therefore, conventionally a technique of providing a recovery oil passage that allows the oil discharged from the rod end oil chamber of the stick cylinder to be supplied to the head end oil chamber has been widely used. In case of providing such a recovery oil passage, it is required to increase the recovery flow rate as much as possible to improve the energy efficiency but in order to increase the recovery flow rate, the rod end oil chamber it is necessary to throttle and reduce the discharge flow rate from the rod end oil passage to an oil tank as much as possible.

On the other hand, for example when excavation is performed by stick-in operation while the bucket is touching down the grounded, or when stick-in operation is performed in order to cause the leading end portion of the stick to approach the machine body beyond the aforementioned vertical line, the pressure of the head end oil chamber of the stick cylinder is higher than the pressure of the rod end oil chamber, and consequently recovery from the rod end oil chamber to the head end oil chamber is no longer performed. If the recovery is no longer performed in this manner, when the discharge flow rate from the rod end oil chamber is throttled, a problem arises that the rod end oil chamber becomes high pressure and an operation speed of the stick cylinder becomes slow. In other words, in case where the recovery from the rod end oil chamber to the head end oil chamber is being performed during the stick-in operation (during extending operation of the stick cylinder), it is required to decrease the discharge flow rate to the oil tank to increase the recovery flow rate. On the other hand, in case where the recovery is not being performed, it is required to increase the discharge flow rate from the rod end oil chamber to the oil tank so that the operation speed of the stick cylinder is not compromised.

Therefore, conventionally, there is known a technique in which, in providing a discharge valve passage that controls the discharge flow rate from the rod end oil chamber to the oil tank during extending operation of the stick cylinder, on a stick control valve that controls supply and discharge of oil to and from the stick cylinder, the discharge valve passage is throttled to increase the recovery flow rate. On the other hand, there is provided an unload valve that relieves the oil in the rod end oil chamber to the oil tank when the pressure of the head end oil chamber exceeds a certain value, and the discharge flow rate can be increased when the recovery is no longer performed by the unload valve (see Patent Literature 1, for example).

PRIOR ART LITERATURES

Patent Literatures

[PATENT LITERATURE 1] Japanese Patent Application Laid-Open No. 1998-311305

SUMMARY OF THE INVENTION

Problems to be Solved by the Invention

However, the construction machine of the Patent Literature 1 requires separately an unload valve for relieving oil in a rod end oil chamber to an oil tank, and an oil passage that extends from the unload valve to the oil tank, in addition to a stick control valve that performs control of supply and discharge of oil to and from the stick cylinder, and thus has a problem that the number of parts is increased, which hinders cost reduction and space saving, and here there are problems to be solved by the present invention.

Means for Solving the Problem

The present invention has been created with an aim of solving these problems in view of the actual circumstances as discussed above. The invention of claim 1 is a stick control system in construction machine, said construction machine being configured to include a boom supported on a machine body in a vertically moveable manner, and a stick supported swingably on a leading end portion of the boom, and swing of the stick is performed based on extending and contracting operation of a stick cylinder, wherein a recovery oil passage that supplies oil discharged from a rod end oil chamber to a head end oil chamber during a stick cylinder extension operation, a supply oil passage for supplying discharge oil of a hydraulic pump to the head end oil chamber, and a discharge oil passage that allows oil discharged from the rod end oil chamber to flow into an oil tank are provided, and in providing a discharge valve passage that controls the flow rate of the discharge valve passage, on a stick control valve for controlling the flow rate of the supply oil passage, or the flow rates of the supply oil passage and the recovery oil passage, a pressure detecting means for detecting pressures in the rod end oil chamber, the head end oil chamber of the stick cylinder respectively, and a controller for controlling an operation of the stick control valve based on an input signal from the pressure detecting means are provided, and the stick control valve is provided with a first region at which the discharge valve passage is opened by throttling and a second region at which the discharge valve passage is wider opened than at the first region, in an operating position when the stick cylinder is extended, and on the other hand, the controller determines whether recovery from the rod end oil chamber to the head end oil chamber is possible based on pressures of the rod end oil chamber and the head end oil chamber during the extension stroke of the stick cylinder, and if it is determined that the recovery is possible, the stick control valve is positioned at the first region, and if it is determined that the recovery is impossible, the stick control valve is positioned at the second region.

The invention of claim 2 is the stick control system in the construction machine according to claim 1, wherein a pump pressure detecting means for detecting a discharge pressure of the hydraulic pump is provided, and on the other hand, the controller, if the discharge pressure of the hydraulic pump is high pressure of equal to or higher than a predetermined set pressure beyond a pressure of the head end oil chamber of the stick cylinder, causes the stick control valve to be positioned at the first region, even if it is determined that the recovery is impossible.

The invention of claim 3 is a stick control system in a construction machine, the construction machine being configured to include a boom supported on a machine body in a vertically movable manner, and a stick supported swingably to a leading end portion of the boom, and to allow swing of the stick to be performed based on extending and contracting operation of a stick cylinder, wherein a recovery oil passage that allows oil discharged from a rod end oil chamber to be supplied to a head end oil chamber, a supply oil passage that allows discharge oil of a hydraulic pump to be supplied to the head end oil chamber, and a discharge oil passage that allows oil discharged from the rod end oil chamber to flow into an oil tank, during extending operation of the stick cylinder, are provided, and in providing a discharge valve passage that controls a flow rate of the discharge oil passage, on first and second stick control valves for controlling a flow rate of the supply oil passage, or flow rates of the supply oil passage and the recovery oil passage, pressure detecting means for detecting pressures of the rod end oil chamber and the head end oil chamber of the stick cylinder respectively, and a controller for controlling operations of the first and second stick control valves based on input signals from the pressure detecting means are provided, and the one stick control valve of the first and second stick control valves allows the discharge valve passage to be opened while being throttled at an operating position during extending operation f the stick cylinder, and on the other hand, the other stick control valve is provided with a first region at which the discharge valve passage is closed and a second region at which the discharge valve passage is wider opened than the discharge valve passage of the one stick control valve, in the operating position during extending operation of the stick cylinder, wherein the controller determines whether a recovery from the rod end oil chamber to the head end oil chamber is possible based on pressures of the rod end oil chamber and the head end oil chamber during extending operation of the stick cylinder, and if it is determined that the recovery is possible, the other stick control valve is positioned at the first region, and if it is determined that the recovery is impossible, the other stick control valve is positioned at the second region.

The invention of claim 4 is the stick control system in the construction machine according to claim 3, wherein a pump pressure detecting means for detecting a discharge pressure of the hydraulic pump that supplies pressurized oil to the stick cylinder passing through the other stick control cylinder, and on the other hand, the controller, if the discharge pressure of the hydraulic pump is high pressure of equal to or higher than a predetermined set pressure beyond a pressure of the head end oil chamber of the stick cylinder, causes the other stick control valve to be positioned at the first region, even if it is determined that the recovery is impossible.

Favorable Effects of the Invention

According to claims 1 and 3 of the present invention, the stick control system, if recovery is possible during extending operation of the stick cylinder, can increase recovery flow rate by throttling discharge flow rate from a rod end oil chamber, thereby enabling contribution to the improvement of energy efficiency, and if recovery is impossible, can avoid an operation speed of the stick cylinder from being impaired, by increasing the discharge flow rate from the rod end oil chamber, and switching between a case of throttling and a case of increasing the aforementioned discharge flow rate becomes able to be performed by providing both a first region and a second region in a stick control valve that controls flow rate of a supply oil passage, or flow rates of a supply oil passage and a recovery oil passage during extending operation of the stick cylinder, thereby eliminating the need for dedicated valves and oil passages for performing the aforementioned switching, enabling contribution to the reduction in the number of parts, and contribution to cost saving and space saving.

According to claims 2 and 4 of the invention of, the stick control system can avoid rapid acceleration of the stick cylinder due to the fact that the pressure of the rod end oil chamber has dropped rapidly in a state where the discharge oil of the hydraulic pump is much higher than the head end oil chamber during extending operation of the stick cylinder.

BRIEF DESCRIPTION OF THE DRAWINGS

FIGS. 3A and 3B are diagrams illustrating the first embodiment, in which FIG. 3A is a diagram explaining a first region of an extending-side operating position of a stick control valve, FIG. 3B is a diagram explaining a second region of an extending-side operating position of the stick control valve.

FIGS. 6A to 6C are diagrams illustrating the second embodiment, in which FIG. 6A is a diagram explaining the extending-side operating position of a first stick control valve, FIG. 6B is a diagram explaining a first region of the extending-side operating position of a second stick control valve, and FIG. 6C is a diagram explaining a second region of the extending-side operating position of the second stick control valve.

FIGS. 7A and 7B are diagrams illustrating the second embodiment, in which FIG. 7A is a diagram explaining opening characteristics of an extending-side operating position of the first stick control valve, and FIG. 7B is a diagram explaining opening characteristics of the first, and second regions of an extending-side operating position of the second stick control valve.

DETAILED DESCRIPTION OF THE INVENTION

Hereinafter, embodiments of the present invention will be discussed with reference to the drawings.

Figure 1:
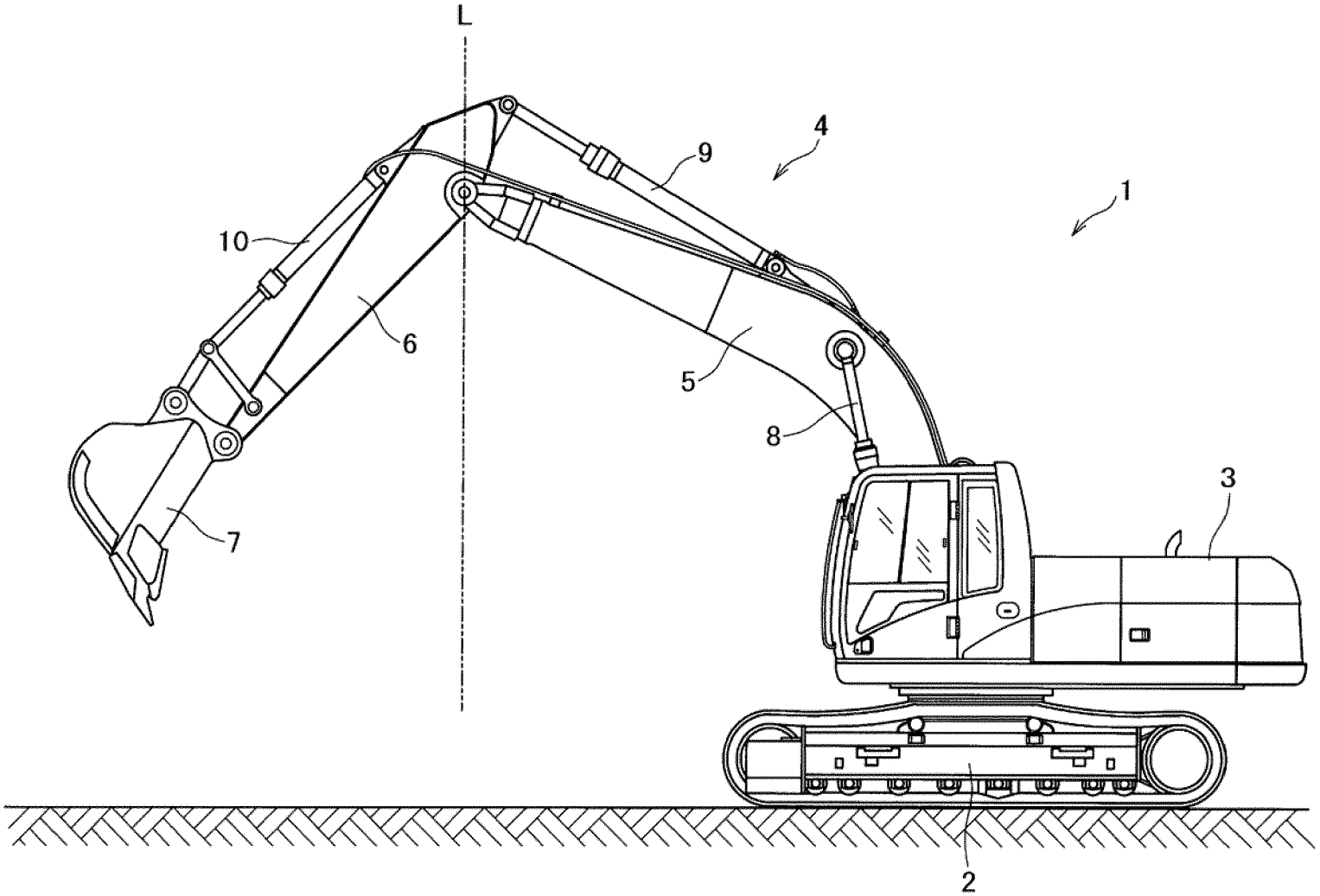
FIG. 1 is a side view of a hydraulic shovel.

First, a first embodiment of the present invention will be discussed with reference to FIGS. 1 to 4. FIG. 1 is a view illustrating a hydraulic shovel 1, which is an example of a construction machine of the present invention, includes various components such as a crawler-type lower traveling body 2; an upper rotating body 3 rotatably supported above the lower traveling member 2, a front work implement 4 mounted on the upper rotating body 3. In addition, the front work implement 4 includes a boom 5 with a base end portion being supported vertically swingably on the upper rotating body 3; a stick 6 supported longitudinally swingably to a leading end portion of the boom 5; and a bucket 7 attached to a leading end portion of the stick 6. The hydraulic shovel 1 is provided with various types of hydraulic actuators such as a boom cylinder 8; a stick cylinder 9; and a bucket cylinder 10 for causing the boom 5; the stick 6; and the bucket 7 to swing respectively; left and right traveling motors (not shown) for causing the lower traveling body 2 to travel; a rotating motor (not shown) for rotating the upper rotating body 3. In FIG. 1, L denotes a vertical line passing a swing support shaft of a base end portion of the stick. The configuration of the hydraulic shovel 1 in the second and third embodiments discussed below is similar to that in the first embodiment, and FIG. 1 is also shared with the second embodiment. A swing of the stick 6 to cause the leading end portion of the stick to move in a direction of coming closer to the machine body by extending the stick cylinder is taken as stick-in (swing to stick-in side), and a swing of the stick 6 to cause the leading end portion of the stick to move in a direction parting away from the machine body by contracting the stick cylinder is taken as stick-out (swing to stick-outside).

Figure 2:
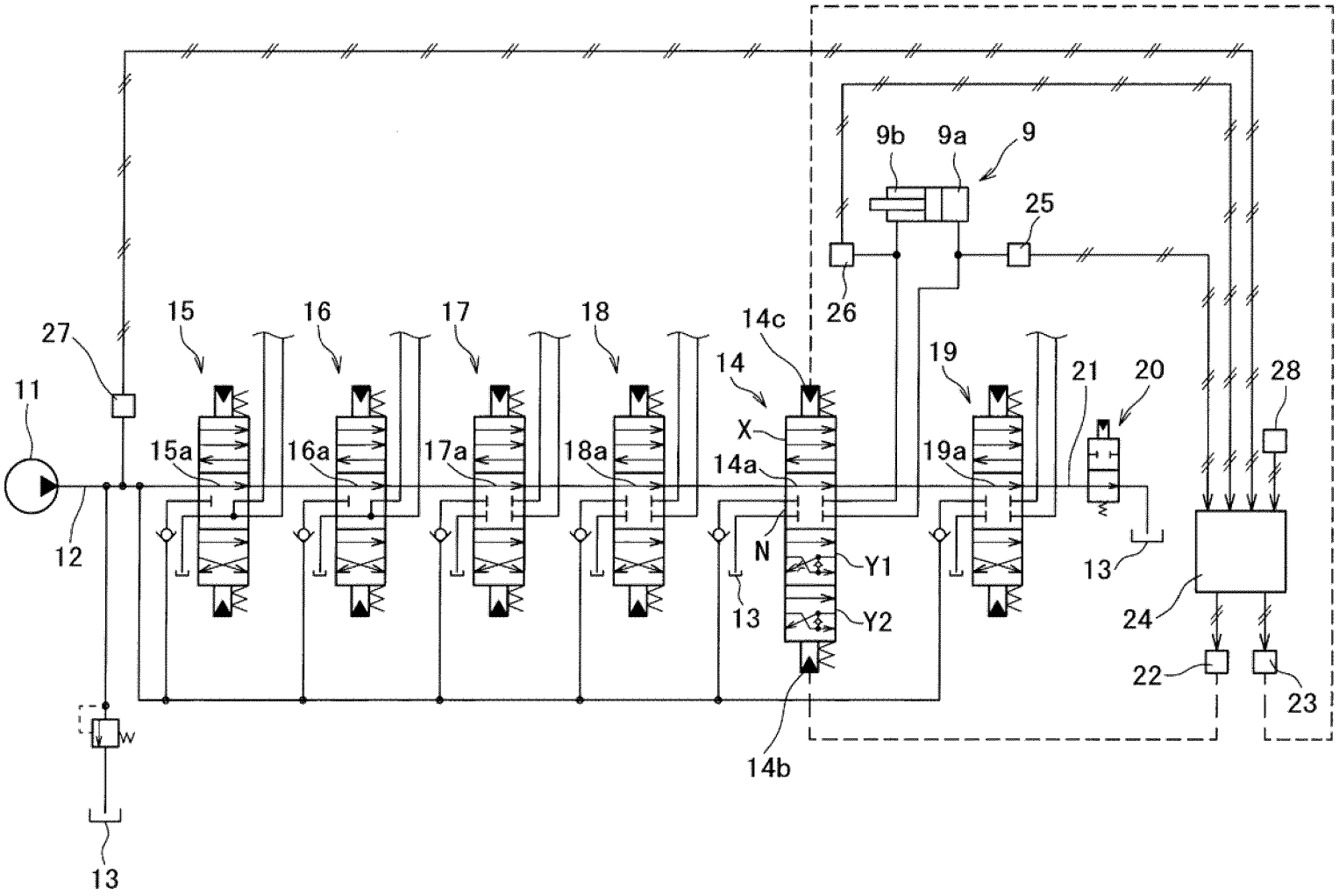
FIG. 2 is a hydraulic control circuit diagram of a stick cylinder in a first embodiment.

The stick cylinder 9 is configured to extend by supply of pressurized oil to the head end oil chamber 9*a* and discharge of oil from the rod end oil chamber 9*b* to cause the stick 6 to swing to in-side, and on the other hand, retract by supply of pressurized oil to the rod end oil chamber 9*b* and discharge of oil from the head end oil chamber 9*a* to cause the stick 6 to swing to out-side. The control of supply and discharge of pressurized oil to and from the stick cylinder 9 will be discussed based on the hydraulic control circuit diagram as illustrated in FIG. 2. In FIG. 2, reference numeral 11 denotes a hydraulic pump serving as a pressurized oil supply source of the stick cylinder 9; 12 denotes a pump oil passage to which the discharge oil of the hydraulic pump 11 is supplied; 13 denotes an oil tank; 14 denotes a stick control valve for performing control of supply and discharge of oil to and from the stick cylinder 9.

In the above FIG. 2, reference numerals 15 to 19 denote control valves for left traveling, for right traveling, for rotating, for boom, for bucket, each connected to the pump oil passage 12. These control valves 15 to 19 switch from a neutral position to an operating position in response to an operation of the respective corresponding operation implements and performs control of supply and discharge of oil to and from the corresponding hydraulic actuators (left and right traveling motors, a rotating motor, a boom cylinder 8, and a bucket cylinder 10), but the detailed description of these control valves 15 to 19 will be omitted. Reference numeral 20 denotes a center bypass control valve, and the center bypass control valve 20 performs flow rate control of a center bypass oil passage 21 that extends from the hydraulic pump 11 to the oil tank 13 sequentially passing through center bypass valve passages 15*a* to 18*a*, 14*a*, 19*a* formed in the respective control valves 15 to 18, 14, and 19. A detailed description of the center bypass control valves 20 will be also omitted.

The stick control valve 14, which is a four-position switching spool valve that includes extending-side and contracting-side pilot ports 14*b* and 14*c*, is configured, in a state where a pilot pressure is not input to both the pilot ports 14*b* and 14*c*, the first boom control valve 16, to be positioned at a neutral position N at which supply and discharge of pressurized oil to and from the stick cylinder 9 is not performed, but to switch to be positioned at the contracting-side operating position X by a pilot pressure being input into the contracting-side pilot port 14*c*, so as to allow the discharge oil of the hydraulic pump 11 to be supplied to the rod end oil chamber 9*b* of the stick cylinder 9, and to allow oil discharged from the head end oil chamber 9*a* to flow into the oil tank 13. Further, the stick control valve 14 switches to be positioned at an extending-side operating position Y when a pilot pressure is input to the extending-side pilot port 14*b*, but a first region Y1 and a second region Y2 are provided in the extending side operating position Y. In this case, the second region Y2 is set up at a position at which the amount of displacement from the neutral position N is larger than that of the first region Y1. In a state where the stick control valve 14 is positioned at the first region Y1, a recovery valve passage 14*e* that allows the oil discharged from the rod end oil chamber 9*b* of the stick cylinder 9 to be supplied to the head end oil chamber 9*a* passing through a check valve 14*d*, and a supply valve passage 14*f* that allows the discharge oil of the hydraulic pump 11 to be supplied to the head end oil chamber 9*a* are opened, and the discharge valve passage 14*g* that allows the oil discharged from the rod end oil chamber 9*b* to flow into the oil tank 13 is opened, but the discharge valve passage 14*g* at the first region Y1 is in a throttled state by a throttle 14*b* (see FIG. 3A). In a state where the stick control valve 14 is positioned at the second region Y2, a recovery valve passage 14*e* that allows the oil discharged from the rod end oil chamber 9*b* of the stick cylinder 9 to be supplied to the head end oil chamber 9*a* passing through the check valve 14*d*, and the supply valve passage 14*f* that allows the discharge oil of the hydraulic pump 11 to be supplied to the head end oil chamber 9*a* are opened, and the discharge valve passage 14*g* that allows the oil discharged from the rod end oil chamber 913 to flow into the oil tank 13 is opened, but the discharge valve passage 14*g* at the first region Y2 is configured to be wider opened than when positioned at the first region Y1 (See FIG. 3B).

Figure 3B:
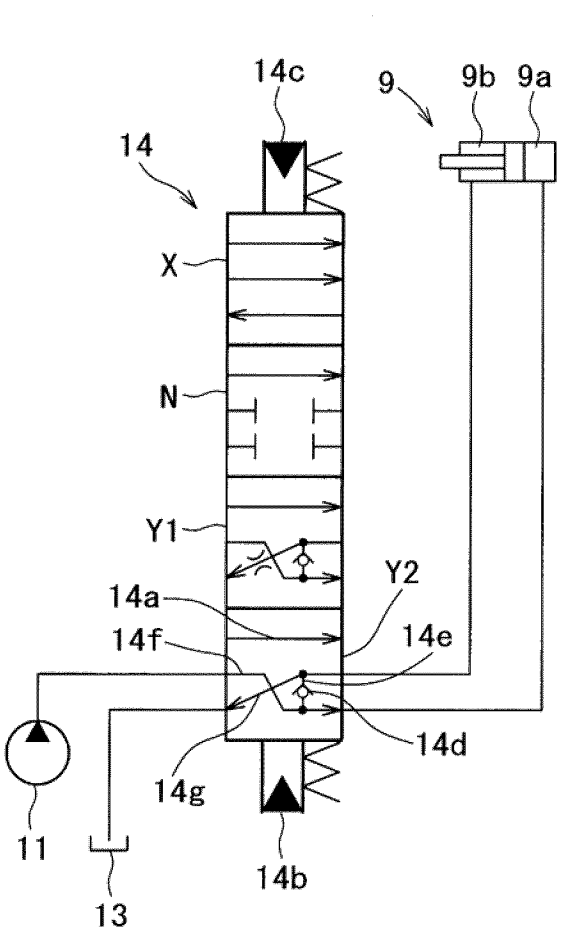
Figure 3A:
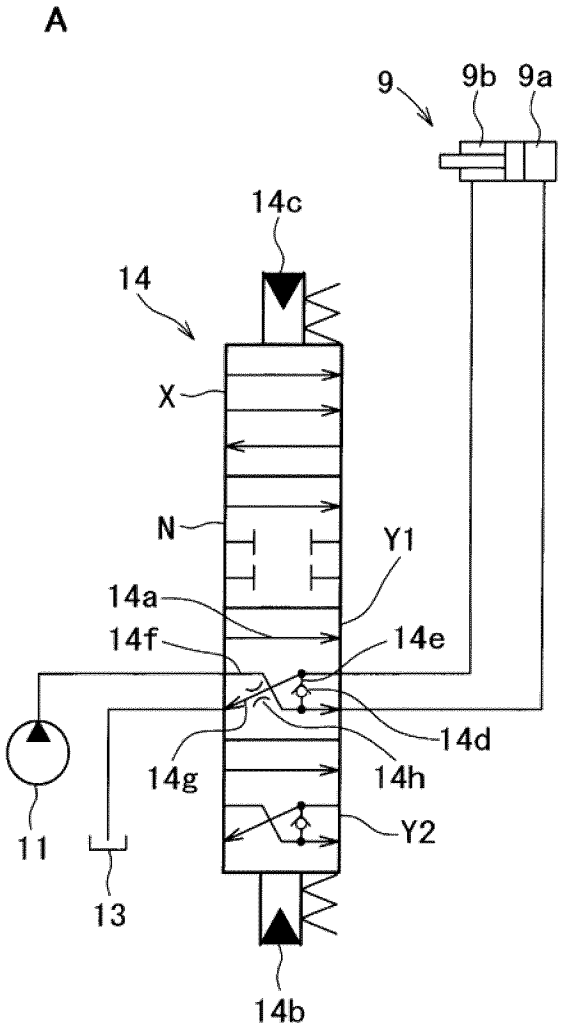

In FIGS. 3A and 3B, oil passages connected to the center bypass valve passage 14*a* of the stick control valve 14 will be omitted.

Figure 4:
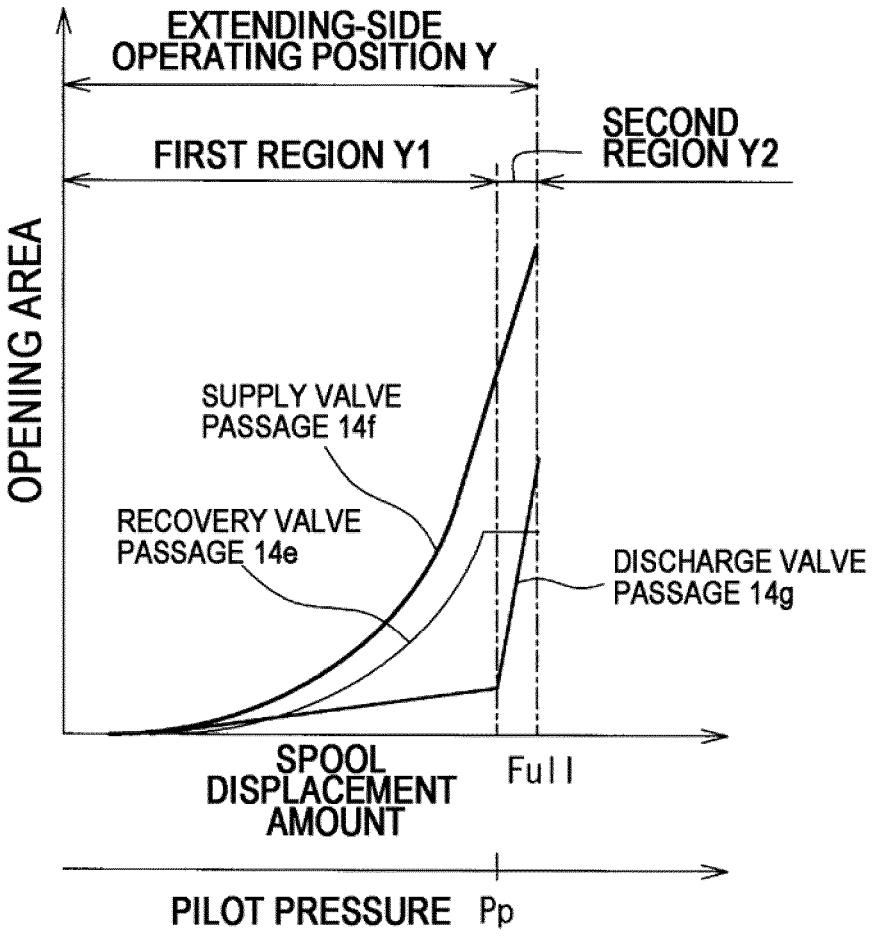
FIG. 4 is a diagram illustrating the first embodiment, and is a diagram explaining opening characteristics of the first and second regions in the extending-side operating position of the stick control valve.

Here, opening characteristics of the recovery valve passage 14*e*, the supply valve passage 14*f*, the discharge valve passage 14*g* positioned at the first region Y1 and the second region Y2 of the extending-side operating position Y of the stick control valve 14 are illustrated in FIG. 4. As illustrated in FIG. 4, at the first region Y1, the more a spool displacement amount increases, the more opening areas of the recovery valve passage 14*e* and the supply valve passage 14*f* are set to increase. In this case, however, the recovery valve passage 14*e* is set to have a maximum opening area at a time point the spool displacement amount is substantially maximum at the first region Y1. Further, an opening area of the discharge valve passage 14*g* at the first region Y1 is set to be slightly increased in a throttled state even when a spool displacement amount increases. On the other hand, when the spool is further displaced beyond the first region Y1 to reach the second region Y2, an opening area of the supply valve passage 14*f* increases even more and an opening area of the recovery valve passage 14*e* maintains a maximum opening area, but an opening area of the discharge valve passage 14*g* is set to be wider opened than when positioned at the first region Y1. A recovery flow rate from the rod end oil chamber 913 to the head end oil chamber 9*a*, a supply flow rate from the hydraulic pump 11 to the head end oil chamber 9*a*, and a discharge flow rate from the rod end oil chamber 9*b* to the oil tank 13 are controlled to increase or decreased, depending on an increase or decrease in the opening areas of the recovery valve passage 14*e*, the supply valve passage 14*f* and the discharge valve passage 14*g* associated with these spool displacements.

On the other hand, in the above FIG. 2, reference numeral 22 denotes an extending-side solenoid valve for outputting a pilot pressure to the extending-side pilot ports 14*b* of the stick control valves 14; 23 denotes a retracting-side solenoid valve for outputting a pilot pressure to the retracting-side pilot port 14*c*. These extracting-side and retracting-side solenoid valves 22 and 23 are operated, based on a control signal from a controller 24 discussed below, to output a pilot pressure of the pressure corresponding to the control signal. The spool of the stick control valves 14 is displaced by a pilot pressure that is output to the extend-side and retracting-side pilot ports 14*b* and 14*c* from these extending-side and the retracting-side solenoid valves 22 and 23, and the stick control valves 14 switches to be positioned at the aforementioned extending-side operating position X and the retracting-side operating position Y in this case, the displacement amount of the spool is controlled to increase or decrease, depending on an increase or decrease in the pilot pressure, and the stick control valve 14 is set to be positioned at the first region Y1 if a pilot pressure output from the extending-side solenoid valve 22 is less than a predetermined pilot pressure Pp and is set to be positioned at the second region Y2 if a pilot pressure is greater than or equal to the predetermined pilot pressure Pp.

Reference numeral 25 denotes a head end pressure sensor for detecting a pressure of the head end oil chamber 9*a* of the stick cylinder 9, 26 denotes a rod end pressure sensor for detecting a pressure of the rod end oil chamber 9*b* of the stick cylinder 9 (these head end and rod end pressure sensors 25 and 26 correspond to a pressure detecting means of the present invention); 27 denotes a pump pressure sensor (which corresponds to a pump pressure detecting means of the present invention) for detecting a discharge pressure of the hydraulic pump 11; 28 denotes an operation detecting means for detecting an operation of a stick operating lever (not shown). The detection signals of these pressure sensors 25, 26 and 27 and the operation detecting means 28 are input to the controller 24. The controller 24 outputs control signals to the extending-side and retracting-side solenoid valves 22 and 23 based on these input signals, thereby controlling the aforementioned switching operation of the stick control valves 14.

To the controller 24 are connected an operation detecting means for detecting respectively operations of the operation implements of the hydraulic actuators (the left and right traveling motors, the rotating motor, the boom cylinder 8, the bucket cylinder 10) other than the stick cylinder 9, and the solenoid valves that output pilot pressures to respective control valves for the hydraulic actuators (respective control valves 15 to 19 for left traveling, for right traveling, for rotating, for boom, for bucket) in response to control signals output from the controller 24 according to the detection signals of these operation detecting means, etc., which are not illustrated in the figures, and description thereof will be omitted.

Next, control of the stick control valves 14 performed by the controller 24 will be discussed. The controller 24 outputs a control signal of a pilot pressure output to the contracting-side solenoid valve 23, when an operation signal of stick-out is input from the operation detecting means 28. In this case, the controller 24 outputs a control signal so that a pilot increases or decreases depending on an increase or decrease in an operation amount of the stick operating lever. Consequently a pilot pressure is input to the retracting side pilot ports 14*c* of the stick control valves 14, and the stick control valves 14 switches to be positioned at the retracting-side operating position X. As discussed above, the stick control valve 14 at the retracting-side operating position X allows the discharge oil of the hydraulic pump 11 to be supplied to the rod end oil chamber 9*b* of the stick cylinder 9, and allows the oil discharged from the head end oil chamber 9*a* to flow into the oil tank 13. Therefore, if an operation of stick-out is performed, the discharge oil of the hydraulic pump 11 is supplied to the rod end oil chamber 9*b* of the stick cylinder 9, passing though the stick control valves 14 at the retracting-side operating position X, and on the other hand, the oil from the head end oil chamber 9*a* is allowed to flow into the oil tank 13.

On the other hand, when an operation signal is input from the operation detecting means 28, the controller 24 determines whether recovery from the rod end oil chamber 9*b* to the head end oil chamber 9*a* is possible, based on pressures of the head end oil chamber 9*a*, the rod end oil chamber 9*b* of the stick cylinder 9 input from the head end, rod end pressure sensors 25 and 26. In this case, if a pressure Pr of the rod end oil chamber 9*b* is greater than a pressure Ph of the head end oil chamber 9*a* (Pr>Ph), it is determined that recovery is possible, and if a pressure Pr of the rod end oil chamber 9*b* is equal to or less than a pressure Ph of the head end oil chamber 9*a* (Pr≤Ph), it is determined that recovery is not possible.

Furthermore, the controller 24, when an operation signal of stick in is input from the operation detecting means 28, determines whether rapid acceleration of stick-in may occur, based on a pressure of the head end oil chamber 9*a* of the stick cylinder 9 input from the head end pressure sensor 25, and a discharge pressure of the hydraulic pump 11 input from the pump pressure sensor 27. In this case, if a discharge pressure P of the hydraulic pump 11 is high pressure of greater than or equal to a predetermined set pressure Ps beyond the pressure Ph of the head end oil chamber 9*a* (P-Ph≥Ps), it is determined that sudden acceleration of stick-in may occur. If the discharge pressure P is not higher pressure of greater than or equal to the set pressure Ps (P-Ph<Ps), it is determined that sudden acceleration of the stick-in may not occur. In other words, should the pressure of the rod end oil chamber 9*b* suddenly drop in a state where the discharge pressure P of the hydraulic pump 11 is much higher than the pressure Ph of the head end oil chamber 9*a*, during stick-in operation, rapid acceleration (stick-in pop-out) against an operator's intention may occur, and therefore the aforementioned determination is made to prevent this rapid acceleration.

Then, the controller 24, when an operation signal of stick-in is input from the operation detecting means 28, outputs a control signal of a pilot pressure output to the extending-side solenoid valve 22, whereby a pilot pressure is input to the extending-side pilot port 14*b* of the stick control valve 14 and the stick control valve 14 switches to be positioned at the extending-side operating position Y. In this case, however, if it is determined that recovery from the rod end oil chamber 9*b* to the head end oil chamber 9*a* is possible (the pressure Pr of the rod end oil chamber 9*b* is greater than the pressure Ph of the head end oil chamber 9*a* (Pr>Ph)), the controller 24 outputs a control signal to the extending-side solenoid valve 22 so as to output a pilot pressure of less than the predetermined pilot pressure Pp, that is, a pilot pressure (a pilot pressure that allows the spool displacement amount to reach the first region Y1) of the pressure for causing the stick control valve 14 to be positioned at the first region Y1. In this case, the controller 24 controls an output pilot pressure from the extending-side solenoid valve 22 so that the spool displacement amount increases or decreases depending on an increase or decrease of an operation amount of the stick operating lever, within the range less than the predetermined pilot pressure Pp (within the range where the stick control valve 14 is positioned at the first region Y1). Consequently, the stick control valve 14 is positioned at the first region Y1, and the recovery valve passage 14*e* that allows the oil discharged from the rod end oil chamber 9*b* of the stick cylinder 9 to be supplied to the head end oil chamber 9*a*, and the supply valve passage 14*f* that allows the discharge oil of the hydraulic pump 11 to be supplied to the head end oil chamber 9*a* are opened, and the discharge valve passage 14*g* that allows the oil discharged from the rod end oil chamber 9*b* to flow into the oil tank 13 in a throttled state is opened.

Contrary to this, if it is determined that recovery from the rod end oil chamber 9*b* to the head end oil chamber 9*a* is impossible, when an operation signal of stick-in is input from the operation detecting means 28 (the pressure Pr of the rod end oil chamber 9*b* is less than or equal to the pressure Ph of the head end oil chamber 9*a* (Pr≤Ph)), the controller 24 outputs a control signal so as to output a pilot pressure that is greater than or equal to the predetermined pilot pressure Pp, that is, a pilot pressure (a pilot pressure that allows the spool displacement amount to reach the second region Y2) of the pressure for causing the stick control valve 14 to be positioned at the second region Y2, to the extending-side solenoid valve 22. In this case, the controller 24 controls an output pilot pressure from the extending-side solenoid valve 22 so that the spool displacement amount increases or decreases depending on an increase or decrease of an operation amount of the stick operating lever, within a range of greater than or equal to the predetermined pilot pressure Pp (within a range of pressure that allows the stick control valve 14 to be positioned at the second region Y2). Consequently, the stick control valve 14 is positioned at the second region Y2, and the supply valve passage 14*f* that allows the discharge oil of the hydraulic pump 11 to be supplied to the head end oil chamber 9*a* of the stick cylinder 9 is further opened, and the recovery valve passage 14*e* that allows the oil discharged from the rod end oil chamber 9*b* of the stick cylinder 9 to be supplied to the head end oil chamber 9*a*, is maintained at the maximum opening area, and the discharge valve passage 14*g* that allows the oil discharged from the rod end oil chamber 9*b* to flow into the oil tank 13 is wider opened than when positioned at the first region Y1. When the stick control valve 14 is positioned at the second region Y2, the recovery valve passage 14*e* that allows the oil discharged from the rod end oil chamber 9*b* to be supplied to the head end oil chamber 9*a* is opened, but recovery is not carried out because the pressure Pr of the rod end oil chamber 9*b* is less than or equal to the pressure Ph of the head end oil chamber 9*a*, and reverse flow is prevented by the check valve 14*d*.

Furthermore, the controller 24, if the discharge pressure P of the hydraulic pump 11 is greater than or equal to the predetermined set pressure Ps beyond the pressure Ph of the head end oil chamber 9*a* (P-Ph≥Ps), when an operation signal of stick-in is input from the operation detecting means 28, that is, if it is determined that sudden acceleration of stick-in may occur, controls the stick control valve 14 so as to be positioned at the first region Y1, even if it is determined that recovery is impossible. Consequently if there is a possibility that sudden acceleration of stick-in may occur, the oil discharged from the rod end oil chamber 9*b* flows into the oil tank 13 passing through the discharge valve passage 14*g* in a throttled state.

Therefore, when stick-in operation is performed, if recovery from the rod end oil chamber 9*b* to the head end oil chamber 9*a* of the stick cylinder 9 is possible, recovery from the rod end oil chamber 9*b* to the head end oil chamber 9*a* is performed, passing through the stick control valve 14 positioned at the first region Y1 of the extending-side operating position Y, and a part of the oil discharged from the rod end oil chamber 9*b* flows into the oil tank 13. In this case, however, since the discharge valve passage 14*g* at the first region Y is in a throttled state, recovery flow rate can be increased, thereby enabling contribution to the improvement of energy efficiency.

On the other hand, if recovery from the rod end oil chamber 9*b* to the head end oil chamber 9*a* of the stick cylinder 9 is impossible, when stick-in operation is performed, the oil discharged from the rod end oil chamber 9*b* flows into the oil tank 13, passing through the stick control valve 14 positioned at the second region Y2 of the extending-side operating position Y. However, since the discharge valve passage 14*g* at the second region Y2 is wider opened, the pressure of the rod end oil chamber 9*b* is quickly decreased, so that a problem that an operation speed of the stick cylinder 9 is decreased due to the high pressure of the rod end oil chamber 9*b* can be surely avoided. Furthermore, even if recovery is impossible, when the discharge pressure P of the hydraulic pump 11 is greater than or equal to the predetermined set pressure Ps beyond the pressure Ph of the head end oil chamber 9*a* (P-Ph≥Ps), the stick control valve 14 is controlled so as to be positioned at the first region Y1, so that an occurrence of sudden acceleration of stick-inn against an operator's intention can be avoided.

In the first embodiment, an oil passage that extends from the rod end oil chamber 9*b* to the head end oil chamber 9*a* of the stick cylinder 9, passing through the recovery valve passage 14*e* of the stick control valve 14 serves as a recovery oil passage of the present invention, an oil passage that extends from the hydraulic pump 11 to the head end oil chamber 9*a* of the stick cylinder 9, passing through the supply valve passage 14*f* of the stick control valve 14 serves as a supply oil passage of the present invention, and an oil passage that extends from the rod end oil chamber 9*b* of the stick cylinder 9 to the oil tank 13, passing through the discharge valve passage 14*g* of the stick control valve 14 serves as a discharge oil passage of the present invention.

In the first embodiment constructed as discussed above, swing of the stick 8 is performed based on the extending and contracting operation of a stick cylinder 9, and the hydraulic circuit of the stick cylinder 9 is provided with a recovery oil passage that allows the oil discharged from the rod end oil chamber 9*b* to be supplied to the head end oil chamber 9*a*, a supply oil passage that allows the discharge oil of the hydraulic pump 11 to be supplied to the head end oil chamber 9*a*, and a discharge oil passage that allows the oil discharged from the rod end oil chamber 9*b* to flow into the oil tank 13, during extending operation of the stick cylinder 9. In the hydraulic circuit, in providing the discharge valve passage 14*g* that controls the flow rate of the discharge oil passage, in the stick control valve 14 for controlling the flow rates of the supply oil passage and the recovery oil passage, head end, rod end pressure sensors 25 and 26 for detecting pressures of the head end oil chamber 9*a*, the rod end oil chamber 9*b* of the stick cylinder 9 respectively, and a controller 24 for controlling an operation of the stick control valve 14 on the basis of input signals from these pressure sensors 25 and 26 are provided, and the stick control valve 14 is provided with a first region Y1 where the discharge valve passage 14*g* to be opened in a throttled state, and a second region Y2 where the discharge valve passage 14*g* is wider opened than at the first region Y1, in an operating position Y during extending operation of the stick cylinder. Then, the controller 24 determines whether recovery from the rod end oil chamber 9*b* to the head end oil chamber 9*a* is possible based on the pressures of the rod end oil chamber 9*b* and the head end oil chamber 9*a* during extending operation of the stick cylinder. If it is determined that recovery is possible, the controller 24 causes the stick control valve 14 to be positioned at the first region Y1, and if it is determined that recovery is impossible, to be positioned at the second region Y2.

As a result, if recovery from the rod end oil chamber 9*b* to the head end oil chamber 9*a* is possible during extending operation of the stick cylinder 9, the stick control valve 14 is positioned at the first region Y1, which allows the oil discharged from the rod end oil chamber 9*b* to flow into the oil tank 13 in a throttled state. Consequently the recovery flow rate can be increased, thereby enabling contribution to the improvement of energy efficiency. On the other hand, if recovery from the rod end oil chamber 9*b* to the head end oil chamber 9*a* during extending operation of the stick cylinder 9 is impossible, the stick control valve 14 is positioned at the second region Y2, and the discharge valve passage 14*g* is wider opened than at the first region Y1. Consequently, the pressure of the rod end oil chamber 9*b* is rapidly decreased, and thereby an operation speed of the stick cylinder 9 can be surely avoided from being impaired.

Also in this hydraulic control circuit, in switching between a case of throttling and a case of increasing the discharge flow rate to the oil tank 13 from the head end oil chamber 9*b* in correspondence with whether or not recovery is possible during extending operation of the stick cylinder 9, it is configured such that the first region Y1 and the second region Y2 are provided in the extending-side operating position Y of the stick control valve 14 for controlling the flow rate of the recovery oil passage and supply oil passage during extending operation of the stick cylinder 9, and at the first region Y1, the discharge valve passage 14*g* is opened in a throttled state, at the second region Y2, the discharge valve passage 14*g* is wider opened than at the first region Y1. By utilizing the stick control valve 14 necessary for performing control of the recovery flow rate and the supply flow rate during extending operation of the stick cylinder 9, it has become possible to switch between a case of throttling and a case of increasing the discharge flow rate to the oil tank 13 from the rod end oil chamber 9*b* in correspondence with whether or not recovery is possible during extending operation of the stick cylinder 9. This will enable contribution to the reduction of number of parts, without separately requiring dedicated valves and oil passages, and contribution to cost saving and space saving.

Furthermore, in this hydraulic control circuit, the controller 24 is configured, when the discharge pressure of the hydraulic pump 11 is high pressure of greater than or equal to the predetermined set pressure Ps beyond the pressure of the head end oil chamber 9*a* of the stick cylinder 9, during extending operation of the stick cylinder 9, to cause the stick control valve 14 to be positioned at the first region Y1, even if it is determined that recovery from the rod end oil chamber 9*b* to the head end oil chamber 9*a* is impossible. Therefore, a sudden acceleration of stick-in due to the fact that the pressure of the rod end oil chamber 9*b* has suddenly dropped in a state where the discharge oil of the hydraulic pump 11 is at a much higher pressure than the head end oil chamber 9*a*, can be avoided.

Figure 5:
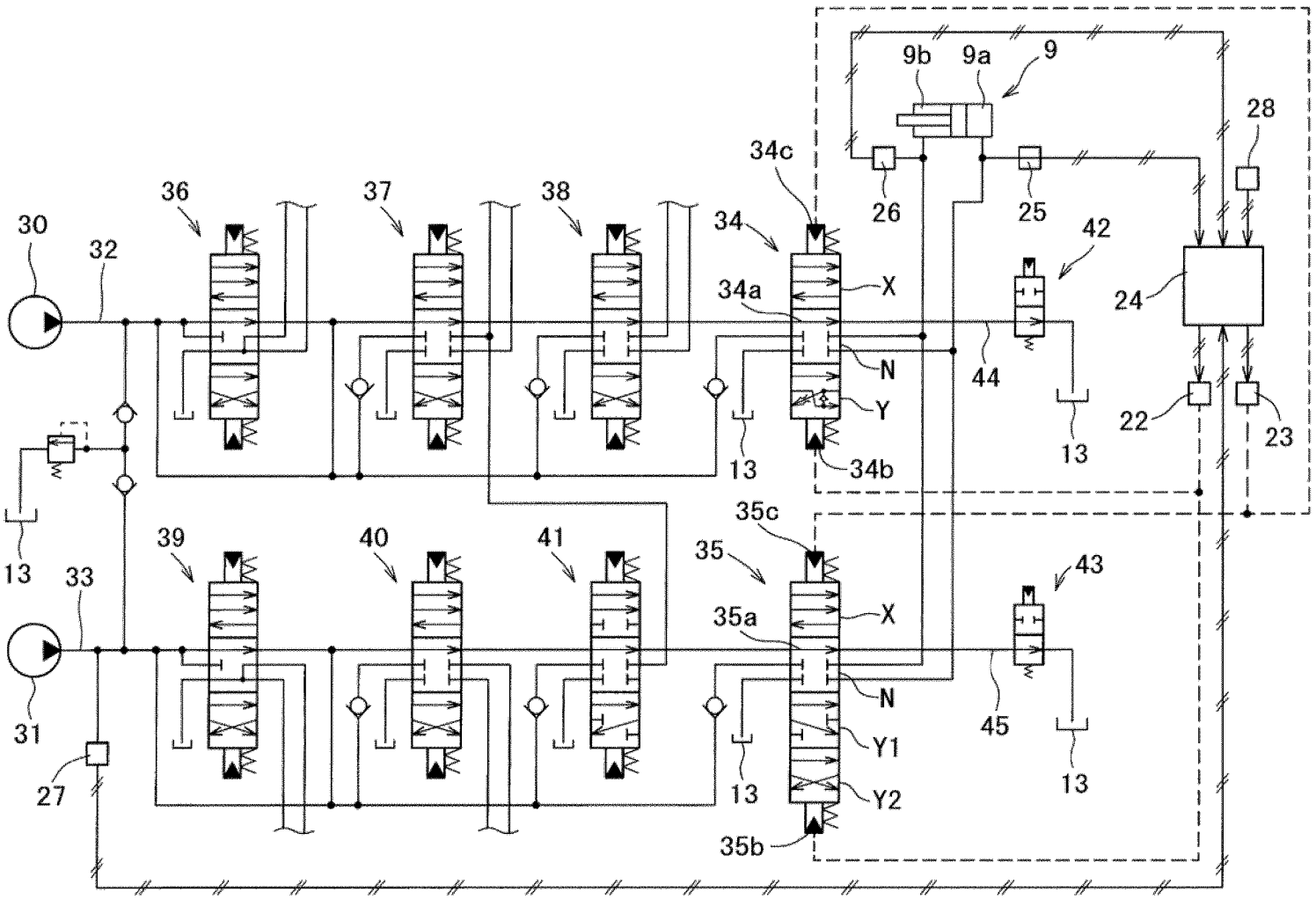
FIG. 5 is a hydraulic control circuit diagram of a stick cylinder in a second embodiment.
Figures 6A, 6B, 6C:
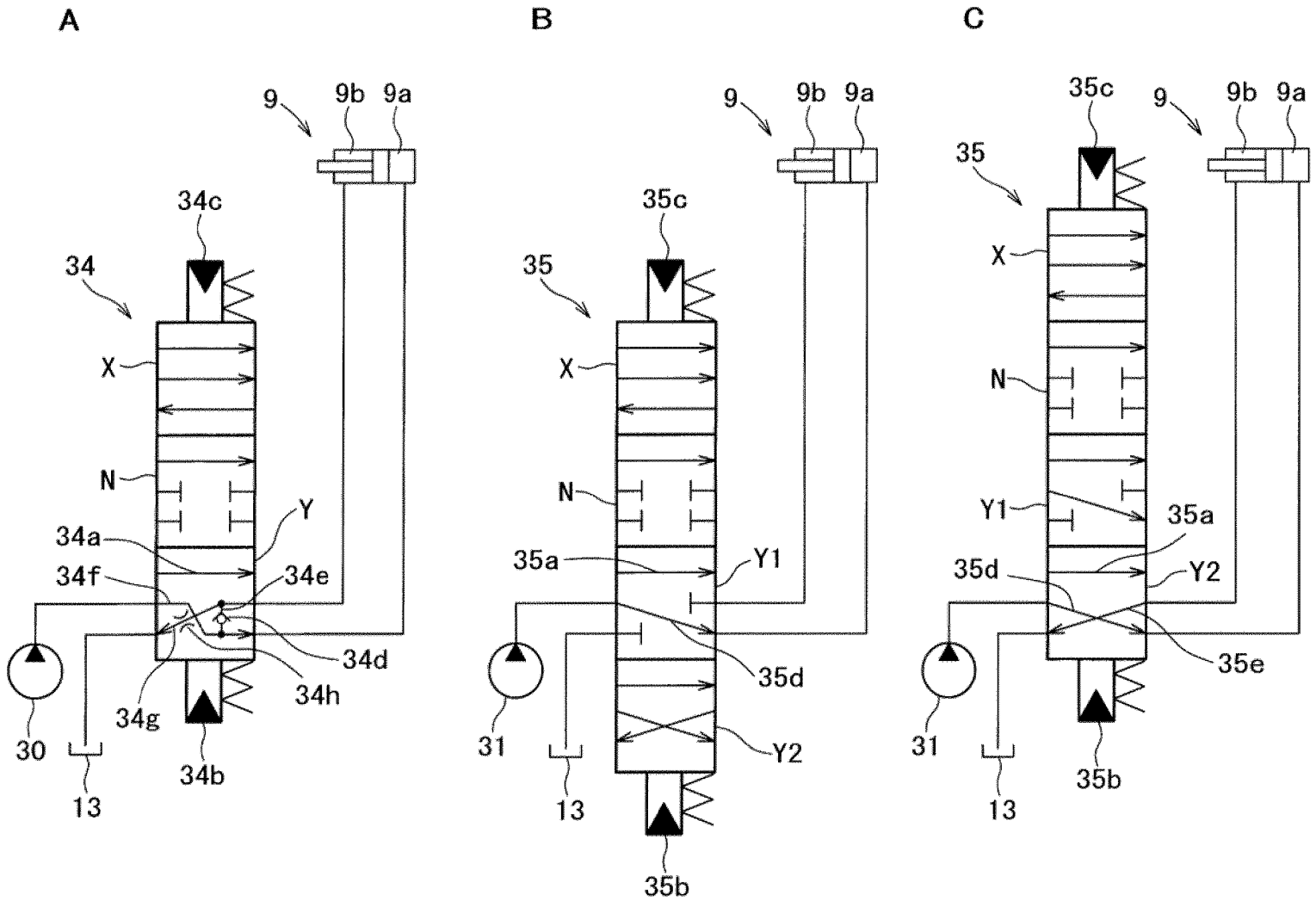

Next, a second embodiment of the present invention will be discussed with reference to FIGS. 5 to 7. FIG. 5 illustrates a hydraulic control circuit diagram of the stick cylinder 9 of the second embodiment. In FIG. 5, reference numerals 30 and 31 denote first, second hydraulic pumps that serve as pressurized oil sources of the stick cylinder 9; 32 and 33 denote first and second pump oil passages to which the discharge oil of the first and second hydraulic pumps 30 and 31 is supplied respectively; 34 and 35 denote first and second stick control valves that perform control of supply and discharge of oil to and from the stick cylinder 9, and the first stick control valve 34 is connected to the first pump oil passage 32, and the second stick control valve 35 is connected to the second pump oil passage 33 respectively.

In FIG. 5, reference numerals 36 to 41 denote control valves for left traveling, for first boom, for bucket, for right traveling, for rotating, for second boom that perform control of supply and discharge of oil to and from left and right traveling motors, a rotating motor, the boom cylinder 8, and the bucket cylinder 10 respectively 42 and 43 denote center bypass control valves that perform flow rate control of the first, second center bypass oil passages 44 and 45, but description thereof will be omitted. In addition, in the second embodiment, the same reference numerals are assigned to the same components as those in the first embodiment, and description thereof will be omitted.

The first stick control valve 34 of the second embodiment is a three-position switching spool valve that includes extending-side, contracting-side pilot ports 34*b* and 34*c*. The first stick control valve 34 is configured, in a state where a pilot pressure is not input to both the pilot ports 34*b* and 34*c*, to be positioned at a neutral position N at which supply and discharge of pressurized oil to the stick cylinder 9 is not performed, but to switch to be positioned at a retracting-side operating position X when a pilot pressure is input to the retracting-side pilot port 34*b*, and to supply the discharge oil of the first hydraulic pump 30 to the rod end oil chamber 9*b* of the stick cylinder 9, and to allow the oil discharged from the head end oil chamber 9*a* to flow into the oil tank 13. The first stick control valve 34 is configured to switch to be positioned at the extending-side operating position Y when a pilot pressure is input to the extending-side pilot port 34*b*, but in a state of being positioned at the extending-side operating position Y, to open the recovery valve passage 34*e* that allows the oil discharged from the rod end oil chamber 9*b* of the stick cylinder 9 to be supplied to the head end oil chamber 9*a* passing through a check valve 34*d*, and the supply valve passage 34*f* that allows the discharge oil of the first hydraulic pump 30 to be supplied to the head end oil chamber 9*a*, as well as to open the discharge valve passage 34*g* that allows the oil discharged from the rod end oil chamber 9*b* to be drained into the oil tank 13, but the discharge valve passage 34*g* is in a throttled state by a throttle 34*h*(See FIG. 6A).

The second stick control valve 35 of the second embodiment, is a four-position switching spool valve that includes extending-side, retracting-side pilot ports 35*b* and 35*c*. The second stick control valve 35 is configured to be positioned at the neutral position N at which supply and discharge of pressurized oil to the stick cylinder 9 is not performed, in a state where a pilot pressure is not input to both the pilot ports 35*b* and 35*c*, hut to switch to be positioned at the retracting-side operating position X when a pilot pressure is input to the retracting-side pilot port 35*c*, and to supply the discharge oil of the second hydraulic pump 31 to the rod end oil chamber 9*b* of the stick cylinder 9, and to allow the oil discharged from the head end oil chamber 9*a* to flow into the oil tank 13. Further, the second stick control valve 35 switches to be positioned at an extending-side operating position Y when a pilot pressure is input to the extending-side pilot port 35*c*, but a first region Y1 and a second region Y2 are provided in the extending-side operating position Y In this case, the second region Y2 is set up at a position at which the amount of displacement from the neutral position N is larger than that of the first region Y1. Then, in a state of being positioned at the first region Y1, the supply valve passage 35*d* that allows the discharge oil of the second hydraulic pump 31 to be supplied to the head end oil chamber 9*a* is opened, and on the other hand, the discharge valve passage 35*e* that allows the oil discharged from the rod end oil chamber 9*b* to be drained into the oil tank 13 is closed (see FIG. 6B). Also, the second stick control valve 35 is configured, ha a state of being positioned at the second region Y2, to open the supply valve passage 35*d* that allows the discharge oil of the second hydraulic pump 31 to be supplied to the head end oil chamber 9*a*, and the discharge valve passage 35*e* that allows the oil discharged from the rod end oil chamber 9*b* to be drained into the oil tank 13, but an opening area of the discharge valve passage 35*e* is set so that its opening area become larger compared with that of the discharge valve passage 35*e* of the first stick control valve 34 at the extending-side operating position. Y. (see FIG. 6C).

In the second embodiment, the first stick control valve 34 corresponds to the one stick control valve according to claims 3 and 4, and the second stick control valve 35 corresponds to the other stick control valve according to claims 3 and 4. In the above FIG. 5 and FIG. 6, reference numerals 34*a* and 35*a* denote center bypass valve passages formed in the first and second stick control valves 34 and 35 respectively. In FIG. 6, oil passages connected to these center bypass valve passages 34*a* and 35*a* will be omitted.

Figure 7B:
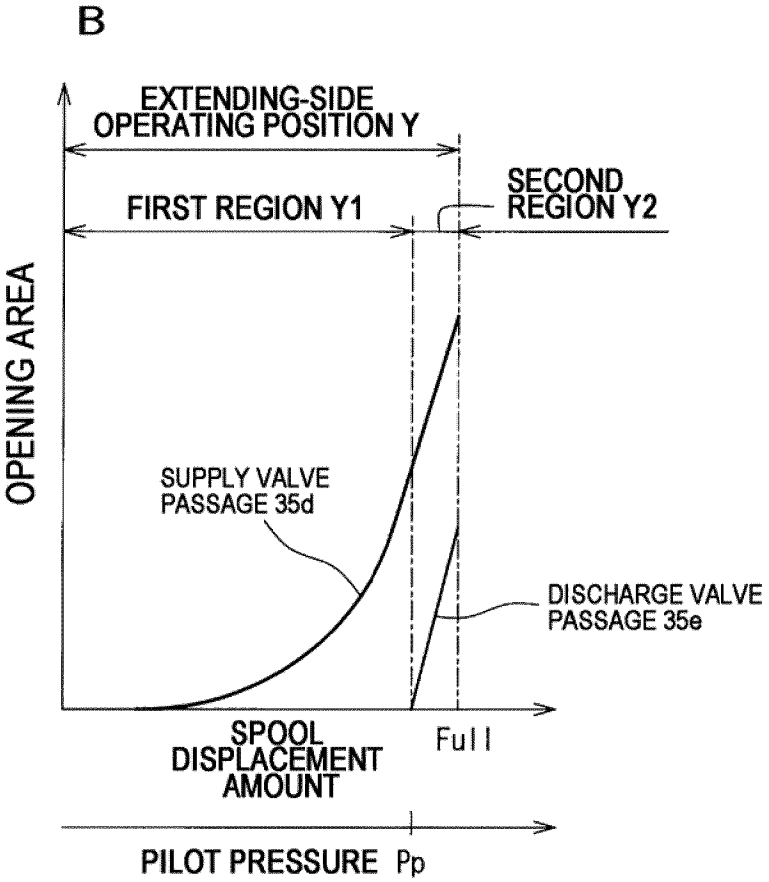
Figure 7A:
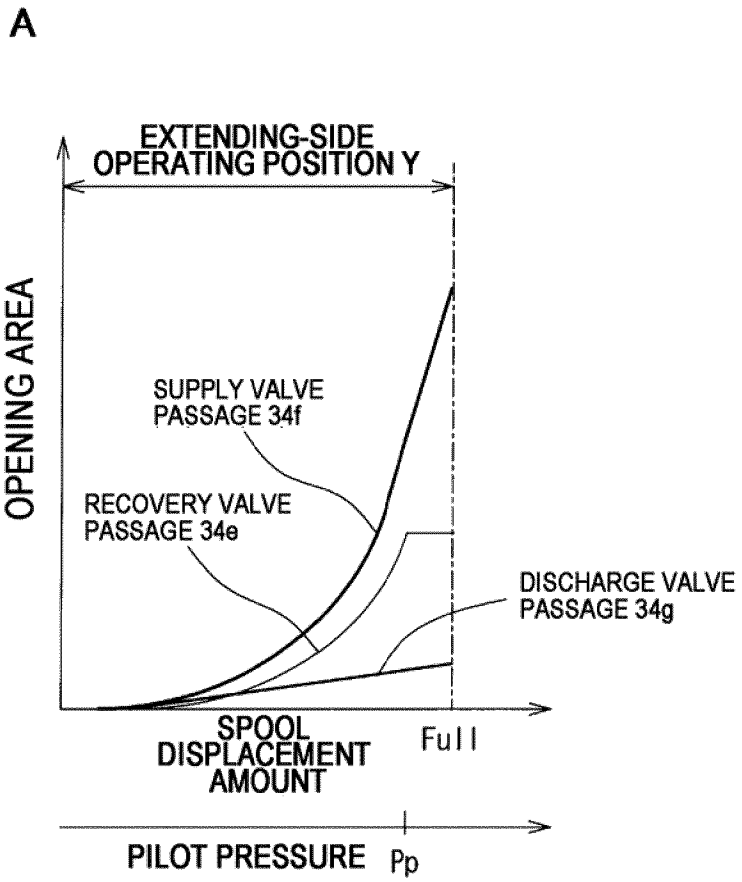

Here, opening characteristics of the recovery valve passage 34*e*, the supply valve passage 34*f*, and the discharge valve passage 34*g* at the extending-side operating position Y of the first stick control valve 34 is illustrated in FIG. 7A. The more a spool displacement amount increases, the more opening areas of the recovery valve passage 34*e* and the supply valve passage 34*f* are set to increase, but in this case, the recovery valve passage 34*e* is set to have a maximum opening area in the vicinity where a spool displacement amount becomes a position corresponding to the predetermined pilot pressure Pp. In addition, the opening area of the discharge valve passage 34*g* is set to be only slightly increased in a throttled state, even if the spool displacement amount is increased. The recovery flow rate from the rod end oil chamber 9*b* to the head end oil chamber 9*a*, the supply flow rate from the first hydraulic pump 30 to the head end oil chamber 9*a*, and the discharge flow rate from the rod end oil chamber 9*b* to the oil tank 13 are controlled to increase or decrease, depending on an increase or decrease of opening areas of the recovery valve passage 34*e*, the supply valve passage 34*f*, and the discharge valve passage 34*g*.

In addition, opening characteristics of the supply valve passage 35*d* and the discharge valve passage 35*e* at the first region Y1 and the second region Y2 of the extending-side operating position Y of the second stick control valve 35 is illustrated in FIG. 7B. As illustrated in FIG. 7B, at the first region Y1, only the supply valve passage 35*d* is opened, and the more a spool displacement amount increases, the more an opening area is set to increase. Further, when the spool is further displaced beyond the first region Y1 to reach the second region Y2, the opening area of the supply valve passage 35*d* becomes further larger and the discharge valve passage 35*e* is opened, but the opening area of the discharge valve passage 35*e* is set to be wider opened than the discharge valve passage 34*g* of the first stick control valve at the extending-side operating position Y. Then, the supply flow rate from the second hydraulic pump 31 to the head end oil chamber 9*a* and the discharge flow rate from the rod end oil chamber 9*b* to the oil tank 13 are controlled to increase or decrease depending on an increase or decrease of the opening areas of the supply valve passage 35*d* and the discharge valve passage 35*e* associated with these spool displacements.

On the other hand, in FIG. 5, reference numerals 22 and 23 denote an extending-side solenoid valve, a retracting side solenoid valve, similarly to the first embodiment, but the extending-side solenoid valve 22 of the second embodiment is configured to output a pilot pressure to the extending-side pilot ports 34*b* and 35*b* of the first and second stick control valves 34 and 35, and the retracting-side solenoid valve 23 is configured to output a pilot pressure to the retracting-side pilot ports 34*c* and 35*c* of the first and second stick control valves 34 and 35. Further, the second stick control valve 35 is set to be positioned at the first region Y1 if a pilot pressure output from the extending-side solenoid valve 22 is less than the predetermined pilot pressure Pp, and is set to be positioned at the second region Y2 if a pilot pressure is greater than or equal to the predetermined pilot pressure Pp. Furthermore, in the second embodiment, the pump pressure sensor 27 is connected to the second pump oil passage 33 in order to detect a discharge pressure of the second hydraulic pump 31.

The first and second stick control valves 34 and 35 are controlled based on a control signal output from the controller 24 similarly to the first embodiment, but the controller 24 outputs a control signal of a pilot pressure to the retracting-side solenoid valve 23, if an operation signal of stick-out is input from the operation detecting means 28. Consequently, both the first and second stick control valves 34 and 35 switch to be positioned at the retracting-side operating position. X, and the discharge oil of both the first and second hydraulic pumps 30 and 31 is supplied to the rod end oil chamber 9*b*.

On the other hand, if an operation signal of stick-in is input from the operation detecting means 28, the controller 24 determines whether recovery is possible from the rod end oil chamber 9*b* to the head end oil chamber 9*a* similarly to the first embodiment. Then, if it is determined that recovery is possible, the controller 24 outputs a control signal so as to output a pilot pressure less than the predetermined pilot pressure Pp, that is, a pilot pressure (a pilot pressure that allows a spool displacement amount to reach the first region Y1) of the pressure for allowing the second stick control valve 35 to be positioned at the first region Y1, to the extending-side solenoid valve 22. Consequently the second stick control valve 35 is positioned at the first region Y1 of the extending-side operating position Y, and the supply valve passage 35*d* that allows the discharge oil of the second hydraulic pump 31 to be supplied to the head end oil chamber 9*a* of the stick cylinder 9 is opened. In addition, the first stick control valve 34 is positioned at the extending-side operating position Y, and the recovery valve passage 34*e* that allows the discharge oil from the head end oil chamber 9*b* of the stick cylinder 9 to be supplied to the head end oil chamber 9*a* is opened, and the supply valve passage 34*f* that allows the discharge oil of the first hydraulic pump 30 to be supplied to the head end oil chamber 9*a* is opened, and the discharge valve passage 34*g* that allows the oil discharged from the rod end oil chamber 9*b* to flow into the oil tank 13 in a throttled state is opened as well.

Contrary to this, if it is determined that recovery is impossible when an operation signal of stick-in is input from the operation detecting means 28, the controller 24 outputs a control signal so as to output a pilot pressure greater than or equal to the predetermined pilot pressure Pp, that is, a pilot pressure is (a pilot pressure that allows the spool displacement amount to reach the second region Y2) of the pressure for causing the second stick control valve 35 to be positioned at the second region Y2, to the extending-side solenoid valve 22. Consequently, the second stick control valve 35 is positioned at the second region Y2 of the extending-side operating position, and the supply valve passage 35*d* that allows the discharge oil of the second hydraulic pump 31 to be supplied to the head end oil chamber 9*a* of the stick cylinder 9 is further opened, and the discharge valve passage 34*d* that allows the oil discharged from the rod end oil chamber 9*b* to be drained into the oil tank 13 is wider opened than the discharge valve passage 34*g* of the first stick control valve 34 at the extending side operating position Y Also, the first stick control valve 34 allows the supply valve passage 34*f* that allows the discharge oil of the first hydraulic pump 30 to be supplied to the head end oil chamber 9*a* is further opened, and the recovery valve passage 34*e* that allows the oil discharged from the rod end oil passage 9*b* of the stick cylinder 9 to the head end oil chamber 9*a*, and the discharge valve passage 34*g* that allows the oil discharged from the rod end oil chamber 9*b* to flow auto the oil tank 13 in a throttled state are opened as well.

Therefore, when stick-in operation has been performed, if recovery from the rod end oil chamber 9*b* to the head end oil chamber 9*a* of the stick cylinder 9 is possible, the oil discharged from the rod end oil chamber 9*b* of the stick cylinder 9 is supplied to the head end oil chamber 9*a* as recovered oil, passing through the first stick control valve 34 at the extending-side operating position Y, and the discharge oil of the first and second hydraulic pumps 30 and 31 is supplied to the head end oil chamber 9*a* passing through the first stick control valve 34 at the extending-side operating position Y and the second stick control valve 35 at the first region Y1 of the extending-side operating position Y respectively. Further, the oil discharged from the rod end oil chamber 9*b* is discharged into the oil tank 13 in a throttled state passing through the first stick control valve 34 at the extending-side operating position Y. On the other hand, when stick-in operation has been performed, if recovery from the rod end oil chamber 9*b* to the head end oil chamber 9*a* of the stick cylinder 9 is impossible, the discharge oil of the first and second hydraulic pumps 30 and 31 is supplied to the head end oil chamber 9*a* passing through the first stick control valve 34 at the extending-side operating position Y and the second stick control valve 35 at the first region Y2 of the extending-side operating position Y respectively, and the oil discharged from the rod end oil chamber 9*b* is discharged into the oil tank 13 in a throttled state passing through the first stick control valve 34 at the extending-side operating position Y, and discharged into the oil tank passing through the first stick control valve 34 at the second region Y2 of the extending-side operating position Y as well.

Furthermore, when stick-in operation has been performed, the controller 24 controls so that the second stick control valve 35 be positioned at the first region Y1 where to close the discharge valve passage 35*e*, also in the second embodiment similarly to the first embodiment, if rapid acceleration of stick-in may occur, even if recovery is impossible, that is, if the discharge pressure P of the second hydraulic pump 31 is greater than the predetermined set pressure Ps beyond the pressure Ph of the head end oil chamber 9*a* (P-Ph≥Ps). Consequently if there is a possibility that rapid acceleration of stick-in may occur, the oil discharged from the rod end oil chamber 9*b* flows into the oil tank 13 passing through the discharge valve passage 34*g* in a throttled state of the first stick control valve 34, thereby sudden acceleration of stick-in can be avoided from occurring against an operator's intention.

In the second embodiment, an oil passage that extends from the rod end oil chamber 9*b* to the head oil chamber 9*a* of the stick cylinder 9 passing through the recovery valve passage 34*e* of the first stick control valve 34 serves as a recovery oil passage of the present invention, and an passage that extends from the first and second hydraulic pumps 30 and 31 to the head end oil chamber 9*a* of the stick cylinder 9 passing through the supply valve passage 34*f* and 35*d* of the first and second stick control valve 34 and 35 serves as a supply oil passage of the present invention. Also, an oil passage that extends from the rod end oil chamber 9*b* of the stick cylinder 9 to the oil tank 13 passing through the discharge valve passages 34*g* and 35*e* of the first and second stick control valves 34 and 35 serves as a discharge oil passage of the present invention.

Also, in the hydraulic control circuit of the second embodiment constructed as discussed above, similarly to the first embodiments as discussed above, there are provided a recovery oil passage that allows the oil discharged from the rod end oil chamber 9*b* to be supplied to the head end oil chamber 9*a*, during extending operation of the stick cylinder 9, a supply oil passage that allows the discharge oil of the first and second hydraulic pumps 30 and 31 to be supplied to the head end oil chamber 9*a*, and a discharge oil passage that allows the oil discharged from the rod end oil chamber 9*b* to flow into the oil tank 13. En the second embodiment, however, the supply oil passage or the first stick control valve 34 and the second stick control valve 35 are provided as the stick control valves controlling the flow rates of the aforementioned supply oil passage, or the supply oil passage and the recovery oil passage. In addition, the first stick control valve 34 allows the discharge valve passage 34*g* to be opened while being throttled at the operating position Y during extending operation of the stick cylinder, and on the other hand, the second stick control valve 35 is provided with a first region Y1 at which the discharge valve passage 35*e* is closed and the second region Y2 at which the discharge valve passage 35*e* is wider opened than the discharge valve passage 34*g* of the first stick control valve 34, in the operating position Y during extending operation of the stick cylinder. The controller 24, similarly to the first embodiment, determines whether recovery from the rod end oil chamber 9*b* to the head end oil chamber 9*a* is possible, based on pressures of the rod end oil chamber 9*b* and the head end oil chamber 9*a* during extending operation of the stick cylinder. If it is determined that recovery is possible, the second stick control valve 35 will be positioned at the first region Y2, and if it is determined that recovery is impossible, the second stick control valve 35 will positioned at the second region Y2.

Therefore, in the hydraulic control circuit of the second embodiment, if recovery from the rod end oil chamber 9*b* to the head end oil chamber 9*a* is possible, the second stick control valve 35 is positioned at the first region Y1 during extending operation of the stick cylinder 9, and the discharge valve passage 35*e* is closed. For this reason the oil discharged from the rod end oil chamber 9*b* flows from the discharge valve passage 34*g* of the first stick control valve 34 at the extending-side operating position Y to the oil tank 13, but the discharge valve passage 34*g* is in a throttled state. Consequently, the recovery flow rate can be increased, thereby enabling contribution to the improvement of energy efficiency. On the other hand, if recovery from the rod end oil chamber 9*b* to the head end oil chamber 9*a* during extending operation of the stick cylinder 9, the second stick control valve 35 is positioned at the second region Y2, and the discharge valve passage 35*e* is wider opened than the discharge valve passage 34*g* of the first stick control valve 34. Consequently the pressure of the rod end oil chamber 9*b* can surely avoided from being quickly decreased, and the operation speed of the stick cylinder 9 can be avoided from being impaired. Therefore, the hydraulic control circuit of the second embodiment will have an operation effect similar to the first embodiment.

And more, also in the hydraulic control circuit of the second embodiment, by using the first and second stick control valves 34 and 35 necessary for performing control of the recovery flow rate and the supply flow rate during extending operation of the stick cylinder 9 it becomes possible to switch between a case of throttling and a case of increasing the flow rate from the rod end oil chamber 9*b* to the oil tank 13 in correspondence with whether or not recovery is possible, thereby enabling contribution to reduction of the number of parts without requiring dedicated valves or oil passages, and enabling contribution to cost saving and space saving.

Furthermore, also in the second embodiment, when the discharge pressure of the second the hydraulic pump 31 that allows pressurized oil to be supplied to the stick cylinder 9 passing through the second stick control valve 35 is high is pressure of greater than or equal to the predetermined set pressure Ps beyond the pressure of the rod end oil chamber 9*b* of the stick cylinder 9, the hydraulic control is configured to cause the second stick control valve 35 to be positioned at the first region Y1, even if it is determined that recovery from the rod end oil chamber 9*b* to the head end oil chamber 9*a* is impossible. Therefore, rapid acceleration of stick-in due to the fact that the pressure of the rod end oil chamber 9*b* has been suddenly dropped in a state where the discharge oil of the second hydraulic pump 31 is in a much higher pressure than the head end oil chamber 9*a*, can be avoided.

It goes without saying that the present invention is not limited to the first, and second embodiments. For example, the stick control valve 14, the first stick control valve 34, the second stick control valve 35 provided in the first and second embodiments are all pilot-operated spool valves switched according to a pilot pressure, but these control valves can also be configured by using spool valves of electromagnetic proportional type that allows control signals to be directly input from the controller. Further, in the second embodiment, the first and second stick control valves 34 and 35 are provided as control valves for performing control of supply and discharge of oil to and from the stick cylinder 9, and it is configured such that pilot pressures are output from the common extending-side, retracting-side solenoid valves 22 and 23 to the extending-side, retracting-side pilot ports 34*b*, 34*c*, 35*b*, 35*c* of these first and second stick control valves 34 and 35. However, in a case where a plurality of stick control valves is provided in this manner, it may be configured to provide individually extending-side, retracting-side solenoid valves for each control valve.

Also, in the first and second embodiments, the stick control valve 14 and the first stick control valve 34 are configured to control the flow rates of the supply oil passage and the recovery oil passage and the flow rate of the discharge oil passage during extending operation of the stick cylinder 9. As a configuration of controlling the flow rates of the supply oil passage and the discharge oil passage, a configuration of providing a recovery valve for controlling the flow rate of the recovery oil passage separately from the stick control valve 14, and the first stick control valve 34 can be also used. Further, in the second embodiment, a configuration of the second stick control valve 35 that allows the discharge valve passage to be opened while being throttled at the operating position during extending operation of the stick cylinder can be used. On the other hand, a configuration of providing the first region at which the discharge valve passage is closed and the second region at which the discharge valve passage is wider opened than the discharge valve passage of the second stick control valve 35, in the operating position during extending operation of the stick cylinder of the first stick control valve 34 can be used.

INDUSTRIAL APPLICABILITY

The present invention can be applied to a stick control system of a construction machine such as a hydraulic shovel equipped with a stick supported swingably to a leading end portion of a boom.

REFERENCE SIGNS LIST

8 stick
9 stick cylinder
9*a* head end oil chamber
9*b* rod end oil chamber
11 hydraulic pump
13 oil tank
14 stick control valve
14*e* recovery valve passage
14*f* supply valve passage
14*g* discharge valve passage
24 controller
25 head end pressure sensor
26 rod end pressure sensor
27 pump pressure sensor
28 operation detecting means
30 first hydraulic pump
31 second hydraulic pump
34 first stick control valve
34*e* recovery valve passage
34*f* supply valve passage
34*g* discharge valve passage
35 second stick control valve
35*d* supply valve passage
35*e* discharge valve passage
Y1 first region
Y2 second region

The invention claimed is:

1. A stick control system in a construction machine, comprising:

a boom supported on a machine body in a vertically movable manner, a stick supported swingably to a leading end portion of the boom, and to allow a swinging operation of the stick to be performed based on extending and contracting operations of a stick cylinder, a recovery oil passage in a stick control valve that allows oil discharged from a rod end oil chamber to be supplied to a head end oil chamber, a supply oil passage in the stick control valve that allows discharge oil of a hydraulic pump to be supplied to the head end oil chamber, a discharge oil passage in the stick control valve that allows oil discharged from the rod end oil chamber to flow into an oil tank during extending operation of the stick cylinder, a discharge valve passage in the stick control valve that controls a flow rate of the discharge oil passage in the stick control valve for controlling a flow rate of the supply oil passage, or flow rates of the supply oil passage and the recovery oil passage, a pressure detecting means for detecting pressures in the rod end oil chamber and the head end oil chamber of the stick cylinder respectively, and a controller for controlling an operation of the stick control valve based on an input signal from the pressure detecting means wherein the stick control valve is provided with a first region at which the discharge valve passage is opened while being throttled and a second region at which the discharge valve passage is opened wider than at the first region, in an operating position during extending operation of the stick cylinder, and wherein the controller determines whether recovery from the rod end oil chamber to the head end oil chamber is possible based on pressures of the rod end oil chamber and the head end oil chamber during extending operation of the stick cylinder, and if it is determined that recovery is possible, the controller outputs a control signal as a pilot pressure to position the stick control valve at the first region, and if it is determined that recovery is impossible, the controller outputs a control signal as a pilot pressure to position the stick control valve at the second region; and wherein the position of the stick control valve at the first region or at the second region is determined by a spool displacement of the stick control valve.

2. The stick control system in the construction machine according to claim 1, wherein a pump pressure detecting means for detecting a discharge pressure of the hydraulic pump is provided, and the controller, if the discharge pressure of the hydraulic pump is of higher than or equal to a predetermined set pressure beyond a pressure of the head end oil chamber of the stick cylinder, causes the stick control valve to be positioned at the first region, even if it is determined that recovery is impossible.

3. A stick control system in a construction machine, comprising:

a boom supported on a machine body in a vertically moveable manner, a stick supported swingably to a leading end portion of the boom, and to allow a swinging operation of the stick to be performed based on extending and contracting operation of a stick cylinder, a recovery oil passage in a first stick control valve that allows oil discharged from a rod end oil chamber to be supplied to a head end oil chamber, a supply oil passage in the first stick control valve that allows discharge oil of a hydraulic pump to be supplied to the head end oil chamber, a discharge oil passage in the first stick control valve that allows oil discharged from the rod end oil chamber to flow into an oil tank during extending operation of the stick cylinder, a discharge valve passage in the first stick control valve that controls a flow rate of the discharge oil passage in a first stick control valve for controlling a flow rate of the supply oil passage, or flow rates of the supply oil passage and the recovery oil passage, a supply oil passage in a second stick control valve that allows discharge oil of a hydraulic pump to be supplied to the head end oil chamber, a discharge oil passage in the second stick control valve that allows oil discharged from the rod end oil chamber to flow into an oil tank during extending operation of the stick cylinder, a pressure detecting means for detecting pressures of the rod end oil chamber and the head end oil chamber of the stick cylinder respectively, and a controller for controlling operations of the first and second stick control valves based on input signals from the pressure detecting means, wherein the first stick control valve of the first and second stick control valves allows the discharge valve passage of the stick control valve to be opened while being throttled at an operating position during extending operation of the stick cylinder, and wherein the second stick control valve of the first and second stick control valves is provided with a first region at which the discharge oil passage of the second stick control valve is closed and a second region at which the discharge oil passage is opened wider than the discharge valve passage of the first stick control valve in the operating position during extending operation of the stick cylinder, wherein the controller determines whether a recovery from the rod end oil chamber to the head end oil chamber is possible based on pressures of the rod end oil chamber and the head end oil chamber during extending operation of the stick cylinder, and if it is determined that the recovery is possible, the controller outputs a control signal as a pilot pressure to position the second stick control valve at the first region, and if it is determined that the recovery is impossible, the controller outputs a control signal as a pilot pressure to position the second stick control valve at the second region; and wherein the position of the second stick control valve at the first region or at the second region is determined by a spool displacement of the second stick control valve.

4. The stick control system in the construction machine according to claim 3, wherein a pump pressure detecting means for detecting a discharge pressure of the hydraulic pump that supplies pressurized oil to the second stick control valve is provided, and the controller, if a discharge pressure of the hydraulic pump is of higher than or equal to a predetermined set pressure beyond a pressure of the head end oil chamber of the stick cylinder, causes the second stick control valve to be positioned at the first region, even if it is determined that the recovery is impossible.

* * * * *